US007845974B2

(12) United States Patent
Yue et al.

(10) Patent No.: US 7,845,974 B2
(45) Date of Patent: Dec. 7, 2010

(54) POWER STRIP

(75) Inventors: Chuang Yue, Shenzhen (CN); Ji-Ying Jin, Shenzhen (CN); En-Long Hao, Shenzhen (CN); Qiang Zhang, Shenzhen (CN); Lie Zhang, Shenzhen (CN); Hong-Yi Tao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/542,706

(22) Filed: Aug. 18, 2009

(65) Prior Publication Data

US 2010/0055930 A1 Mar. 4, 2010

(30) Foreign Application Priority Data

Aug. 27, 2008 (CN) ..... 200810304216.1

(51) Int. Cl.
*H01R 13/72* (2006.01)

(52) U.S. Cl. ..... 439/501; 439/40; 439/652; 191/12.4

(58) Field of Classification Search ..... 439/40, 439/501, 38, 652, 215, 535; 191/12.4, 12.2
See application file for complete search history.

(56) References Cited

U.S. PATENT DOCUMENTS

| | | | | | |
|---|---|---|---|---|---|
| 5,562,488 | A * | 10/1996 | Neiser et al. | ..... | 439/501 |
| 5,700,158 | A * | 12/1997 | Neiser et al. | ..... | 439/501 |
| 5,701,981 | A * | 12/1997 | Marshall et al. | ..... | 191/12.4 |
| 6,648,677 | B1 * | 11/2003 | Boyd | ..... | 439/501 |
| 7,510,426 | B2 * | 3/2009 | Hwang et al. | ..... | 439/501 |
| 7,753,682 | B2 * | 7/2010 | Gerard | ..... | 439/13 |
| 7,758,376 | B2 * | 7/2010 | Hwang et al. | ..... | 439/501 |
| 2002/0151212 | A1 * | 10/2002 | Neiser | ..... | 439/501 |

* cited by examiner

*Primary Examiner*—Gary F. Paumen
(74) *Attorney, Agent, or Firm*—Zhigang Ma

(57) ABSTRACT

A power strip is provided. The power strip includes a first power cord to receive an input of electricity. The power strip also includes a housing including a plurality of socket modules for receiving electrical plugs. At least one socket module is removably attached to the housing and includes a second power cord connect to the first power cord.

15 Claims, 3 Drawing Sheets

POWER STRIP

BACKGROUND

1. Technical Field

The present disclosure relates to power strips and, more particularly, to a power strip including at least one socket module removably attached to a housing thereof.

2. Description of Related Art

The popularity of electrical power strips has grown in pace with the increased use of personal computer equipment, electrical appliances, and the like. However, due to the different positions equipment may be placed in a location, the shared use of one power strip becomes difficult. Therefore, there is a need to provide a power strip that includes an extendable socket module to solve the abovementioned problem.

BRIEF DESCRIPTION OF THE DRAWINGS

The components of the drawings are not necessarily drawn to scale, the emphasis instead being placed upon clearly illustrating the principles of the power strip. Moreover, in the drawings, like reference numerals designate corresponding parts throughout several views.

DETAILED DESCRIPTION

Figure 1:
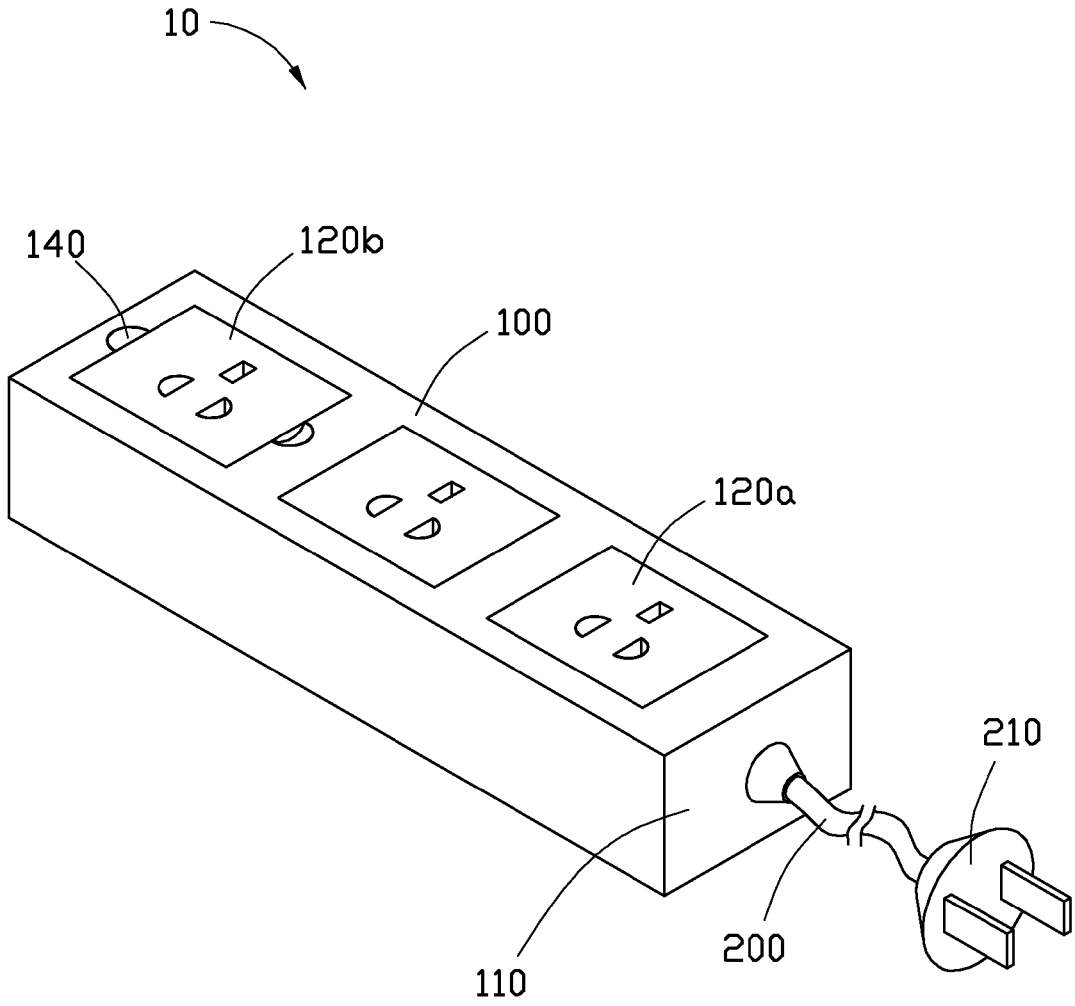
FIG. 1 is an isometric view of a power strip in accordance with an exemplary embodiment.
Figure 2:
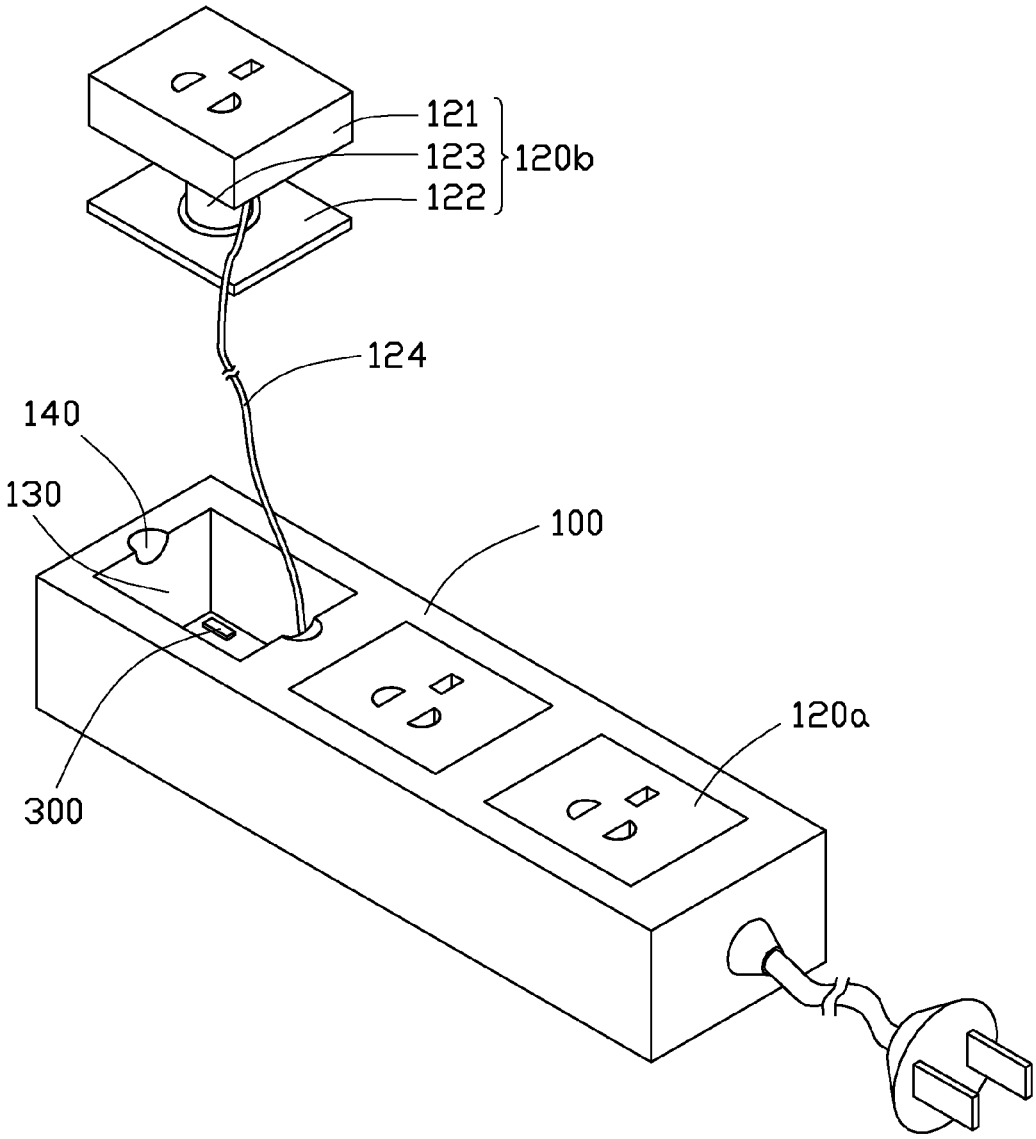
FIG. 2 is an isometric view of the power strip of FIG. 1, which shows a socket module is removed from a housing of the power strip.
Figure 3:
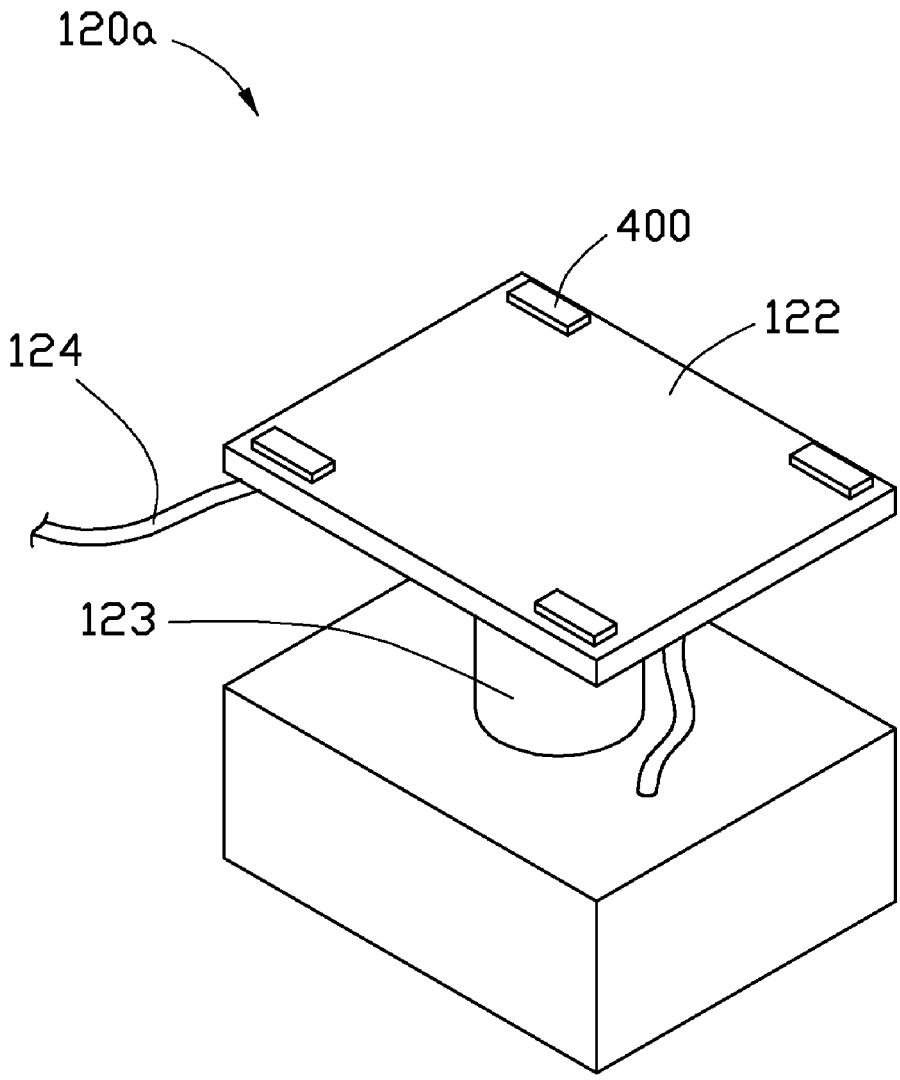
FIG. 3 is an isometric view of the socket module of FIG. 2.

Referring to FIGS. 1-3, in an exemplary embodiment, a power strip 10 includes a housing 100 and a first power cord 200. The housing 100 is substantially rectangular and includes a front surface 110. The cord 200 extends from the front surface 110 and is used to receive an input of electricity from a power source (not shown). The cord 200 includes a plug 210 that may be plugged into a wall outlet (not shown).

The housing 100 further includes a plurality of socket modules 120*a* and at least one socket module 120*b* arranged in an upper surface of the housing 100 for receiving electrical plugs (not shown). In the exemplary embodiment, each of the socket modules 120*a* and the socket module 120*b* includes three socket holes. However, the number of the socket holes of each socket module is not limited and may be two or more than three according to need.

In the exemplary embodiment, the socket modules 120*a* are fixed to the housing 100 and the socket module 120*b* is removably attached to the housing 100. Specifically, a hollow cavity 130 is formed in the housing 100 and the socket module 120*b* is received in the hollow cavity 130.

In the exemplary embodiment, the socket module 120*b* includes a top portion 121, a bottom portion 122, and a reel portion 123 extended therebetween. The three socket holes of the socket module 120*b* are formed in the top surface of the top portion 121.

The top portion 121 is hollow and includes connectors (not shown) for engaging with electrical plugs (not shown). A second power cord 124 is connected to the connectors and is guided out through an opening (not labeled) formed in the bottom surface of the top portion 121. The second power cord 124 is connected to the first power cord 200.

The reel portion 123 is a round protrusion protruded from the bottom portion 122. The second power cord 124 is wound on the reel portion 123. The bottom portion 122 is a rectangular plate.

In the exemplary embodiment, four magnetic members 300 are disposed on the bottom surface bounding the cavity 130 and four magnetic members 400 are attached to the bottom surface of the bottom portion 122. The four magnetic members 400 are placed on the corners of the bottom portion 122. The magnetic members 300 and 400 are disposed so they attract one another, thereby enabling the socket module 120*b* to be removably attached to the housing 100.

In another embodiment, four magnetic members 300 are disposed on the bottom surface of the cavity 130 and the bottom portion 122 is made of metal material. The magnetic members 300 are disposed to attract the bottom portion 122, thereby enabling the socket module 120*b* to be removably attached to the housing 100.

In the exemplary embodiment, two recessed portions 140 are formed in the upper surface of the housing 100 and communicate with the cavity 130. The two recessed portions 140 enable a user's fingers to grasp two side walls of the top portion 121 to draw the socket module 120*b* out of the cavity 130.

When in use, a user can remove the socket module 120*b* from the housing 100 and rotate the socket module 120*b* to release the second power cord 124 wound on the reel portion 123. With the second power cord 124 released, the socket module 120*b* can then be placed in a position away from the housing 100, thereby enabling more flexibility in the placement of equipment (not shown) releative to placement of the power strip 10.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A power strip comprising:

a first power cord to receive an input of electricity; and a housing comprising a plurality of first socket modules for receiving electrical plugs, and at least one second socket module being removably attached to the housing and each having a second power cord connected to the first power cord;

wherein the housing further comprises at least one cavity to receive the at least one second socket module;

wherein the power strip further comprises at least one first magnetic member placed on the bottom of each of the least one cavity, wherein each of the at least one second socket module comprises a flat bottom portion and at least one second magnetic member disposed thereon, the at least one first and the at least one second magnetic members attract one another.

2. The power strip according to claim 1, wherein the bottom portion is a rectangular plate.

3. The power strip according to claim 1, wherein each of the at least one second socket module comprises a round protrusion protruded from the flat bottom portion, the second power cord is wound on the round protrusion.

4. The power strip according to claim 1, wherein each of the plurality of first socket modules comprises three socket holes.

5. The power strip according to claim 1, wherein the first and second magnetic members are each four in number.

6. The power strip according to claim 5, wherein the at least one second magnetic member is placed on the corners of the rectangular plate.

7. The power strip according to claim 1, further comprising at least one first magnetic member placed on the bottom of the cavity, wherein the at least one second socket module comprises a flat bottom portion made of metal material.

8. The power strip according to claim 1, wherein at least one recessed portion is formed on an upper surface of the housing communicating with each cavity.

9. A power strip comprising:

a first power cord to receive an input of electricity; and a housing comprising a plurality of first socket modules for receiving electrical plugs, and at least one second socket module being removably attached to the housing and each having a second power cord connected to the first power cord;

wherein the housing further comprises at least one cavity to receive the at least one second socket module, the at least one cavity comprises a rectangular cross section, the at least one second socket module comprises a rectangular bottom fitted into the at least one cavity, the at least one second socket module is able to retain in two different orientations by the engagement of the rectangular bottom with the at least one cavity.

10. The power strip according to claim 9, further comprising at least one first magnetic member placed on the bottom of the least one cavity, wherein each of the at least one second socket module comprises at least one second magnetic member arranged on rectangular bottom, the at least one first and the at least one second magnetic members attract one another.

11. The power strip according to claim 9, wherein each of the at least one second socket module comprises a round protrusion protruded from the rectangular bottom, the second power cord is wound on the round protrusion.

12. A power strip comprising:

a first power cord to receive an input of electricity; and a housing comprising a plurality of first socket modules for receiving electrical plugs, and at least one second socket module being magnetically and removably attached to the housing and each having a second power cord connected to the first power cord.

13. The power strip according to claim 12, wherein the housing further comprises at least one cavity to receive the at least one second socket module.

14. The power strip according to claim 13, further comprising at least one first magnetic member placed on the bottom of each of the least one cavity, wherein each of the at least one second socket module comprises a bottom and at least one second magnetic member arranged thereon, the at least one first and the at least one second magnetic members attract one another.

15. The power strip according to claim 14, wherein the at least one cavity and the at least one second socket module are rectangular, allowing the at least one socket module to be retained in two different orientations by the engagement of the bottom with the at least one cavity.

* * * * *